US007246794B2

(12) United States Patent
Suzuki et al.

(10) Patent No.: US 7,246,794 B2
(45) Date of Patent: Jul. 24, 2007

(54) CARBURETOR THROTTLE VALVE CONTROL SYSTEM

(75) Inventors: Takashi Suzuki, Saitama (JP); Hiroshi Moriyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/366,840

(22) Filed: Mar. 3, 2006

(65) Prior Publication Data

US 2006/0208371 A1 Sep. 21, 2006

(30) Foreign Application Priority Data

Mar. 7, 2005 (JP) ..... 2005-061834

(51) Int. Cl.
*F02M 7/12* (2006.01)

(52) U.S. Cl. ..... 261/52; 123/376; 261/39.4

(58) Field of Classification Search ..... 261/39.1–39.6, 261/52, 64.1–64.6; 123/376
See application file for complete search history.

(56) References Cited

U.S. PATENT DOCUMENTS

| | | | | |
|---|---|---|---|---|
| 3,743,254 | A * | 7/1973 | Tuckey | 261/34.2 |
| 4,016,842 | A * | 4/1977 | Kittler | 123/389 |
| 4,094,281 | A * | 6/1978 | Kittler | 123/396 |
| 4,117,809 | A * | 10/1978 | Kittler | 123/403 |
| RE31,233 | E * | 5/1983 | Nutten et al. | 123/330 |
| 4,631,153 | A * | 12/1986 | Tamba et al. | 261/52 |
| 4,860,608 | A * | 8/1989 | Kobayashi | 74/501.6 |
| 4,961,409 | A * | 10/1990 | Kobayashi et al. | 123/376 |
| 5,146,889 | A * | 9/1992 | Swanson et al. | 123/376 |
| 5,809,979 | A * | 9/1998 | Tsuda et al. | 123/525 |
| 6,082,323 | A * | 7/2000 | Winberg | 123/198 DB |
| 6,598,586 | B2 * | 7/2003 | Deschamps et al. | 123/376 |
| 6,612,286 | B1 * | 9/2003 | Houston | 123/376 |
| 6,983,736 | B2 * | 1/2006 | Mitchell et al. | 123/376 |
| 7,097,163 | B2 * | 8/2006 | Moriyama et al. | 261/52 |
| 7,118,097 | B2 * | 10/2006 | Moriyama et al. | 261/39.4 |
| 7,152,580 | B2 * | 12/2006 | Wetor et al. | 123/376 |
| 2005/0194700 | A1 * | 9/2005 | Moriyama et al. | 261/39.4 |
| 2005/0194701 | A1 * | 9/2005 | Moriyama et al. | 261/39.4 |
| 2006/0022359 | A1 * | 2/2006 | Edamatsu et al. | 261/39.1 |
| 2006/0130808 | A1 * | 6/2006 | Steffes et al. | 123/376 |
| 2006/0130809 | A1 * | 6/2006 | Wetor et al. | 123/376 |

FOREIGN PATENT DOCUMENTS

| | | | | |
|---|---|---|---|---|
| JP | 60-21535 U | | 2/1985 | |
| JP | 60-30459 A | * | 2/1985 | 261/39.4 |

* cited by examiner

*Primary Examiner*—Richard L. Chiesa
(74) *Attorney, Agent, or Firm*—Arent Fox LLP.

(57) ABSTRACT

A carburetor valve control system for stabilizing engine warm-up operating conditions by automatically controlling the degree of opening of a throttle valve so as to be larger than a normal degree of opening for idling, without carrying out a special operation of appropriately strengthening the spring force of a governor spring. The carburetor throttle valve control system includes a throttle lever and a governor system coupled to the throttle lever. A choke return spring is connected to a choke lever, the choke return spring urging the choke lever to a choke valve closing side. An automatic choke system is disposed so as to face the choke lever. A throttle valve closure restricting member is provided between the throttle lever and the choke lever. During engine warming-up, when the spring force of a governor spring is adjusted to zero or a minimum, the choke lever restricts closing of the throttle valve via the throttle lever by means of the spring force of the choke return spring.

4 Claims, 15 Drawing Sheets

CARBURETOR THROTTLE VALVE CONTROL SYSTEM

RELATED APPLICATION DATA

The present application is based upon Japanese priority application No. 2005-061834, filed Mar. 7, 2005, which is hereby incorporated in its entirety herein by reference.

BACKGROUND OF THE INVENTION

The present invention relates to an improvement of a carburetor throttle valve control system comprising a throttle lever for opening and closing a throttle valve of a carburetor; and a governor system coupled to the throttle lever. The governor system includes a governor spring that exerts a spring force on the throttle lever in a direction to open the throttle valve, the spring force being adjusted via an output control member by an operator; and a governor that, when an engine is running, exerts an output on the throttle lever in a direction to close the throttle valve, and increases the output in response to an increase in the rotational speed of the engine.

DESCRIPTION OF THE RELATED ART

A carburetor throttle valve control system is already known, as disclosed in, for example, Japanese Utility Model Registration Application Laid-open No. 60-21535. Conventionally, in such a carburetor throttle valve control system, during warming up of the engine, in order to stabilize idling, the degree of opening of the throttle valve is generally made larger than a normal degree of opening for idling by appropriately strengthening the spring force of the governor spring. Therefore, if the operation of appropriately strengthening the spring force of the governor spring when the engine is warming up is neglected, idling of the engine becomes unstable, and engine stalling might occur.

SUMMARY OF THE INVENTION

The present invention has been accomplished under such circumstances, and it is an object thereof to provide a carburetor throttle valve control system that can stabilize engine warm-up operating conditions by automatically controlling the degree of opening of a throttle valve so that it is made larger than a normal degree of opening for idling when the engine is warming up, without carrying out a special operation for strengthening the spring force of a governor spring.

In order to achieve the above object, according to a first feature of the present invention, there is provided a carburetor throttle valve control system comprising a throttle lever for opening and closing a throttle valve of a carburetor; and a governor system coupled to the throttle lever, the governor system including a governor spring that exerts a spring force on the throttle lever in a direction to open the throttle valve, the spring force being adjusted via an output control member by an operator; and a governor that, when an engine is running, exerts an output on the throttle lever in a direction to close the throttle valve, and increases the output in response to an increase in the rotational speed of the engine. A choke return spring is connected to a choke lever for opening and closing a choke valve of the carburetor, the choke return spring urging the choke lever to the choke valve closing side. A throttle valve closure restricting means is provided between the throttle lever and the choke lever, the throttle valve closure restricting means being arranged so that, during warming up of the engine, the choke lever restricts closing of the throttle valve via the throttle lever by means of the spring force of the choke return spring when the spring force of the governor spring is adjusted to zero or a minimum by the output control member.

According to a second feature of the present invention, in addition to the first feature, the throttle valve closure restricting means comprises a restricted arm formed on the throttle lever; and a restricting arm that is formed on the choke lever. During warming up of the engine, the restricting arm restricts closing of the throttle valve by abutting against the restricted arm when the spring force of the governor spring is adjusted to zero or a minimum by the output control member.

According to a third feature of the present invention, in addition to the first or second feature, the choke lever is disposed so as to oppose an automatic choke system that automatically controls the degree of opening of the choke valve in response to a change in temperature of the engine and makes the throttle valve closure restricting means inoperative.

The output control member and the governor correspond to an output control lever 56 and a centrifugal governor 55 of an embodiment of the present invention, which will be described later.

With the first feature of the present invention, during warming up of the engine, the choke valve is held at a closed position by the action of the spring force of the choke return spring. In this state, if the spring force of the governor spring is adjusted to zero or a minimum, the throttle valve is moved in the valve-closing direction by the output of the governor, but before the throttle valve reaches a position for the degree of opening for idling, the closing of the throttle valve is restricted by operation of the throttle valve closure restricting means provided between the throttle lever and the choke lever. Therefore, when the engine is warming up, the degree of opening of the throttle valve is automatically controlled so as to be larger than a normal degree of opening for idling without carrying out a special operation for appropriately strengthening the spring force of the governor spring, thereby securing stable engine warm-up operating conditions to improve the ease of manipulation of the engine.

With the second feature of the present invention, the throttle valve closure restricting means can be formed from a simple structure comprising the restricted arm and the restricting arm.

With the third feature of the present invention, the choke valve is opened by the automatic choke system and the throttle valve closure restricting means is made inoperative about time when engine warming up is completed, so that the throttle valve can be closed up to the degree of opening for idling without being interfered with by the choke lever or the choke return spring. Therefore, it is unnecessary to carry out a special operation for canceling the operation of the throttle valve closure restricting means, thus further improving the ease of manipulation of the engine.

DETAILED DESCRIPTION OF THE INVENTION

Figure 1:
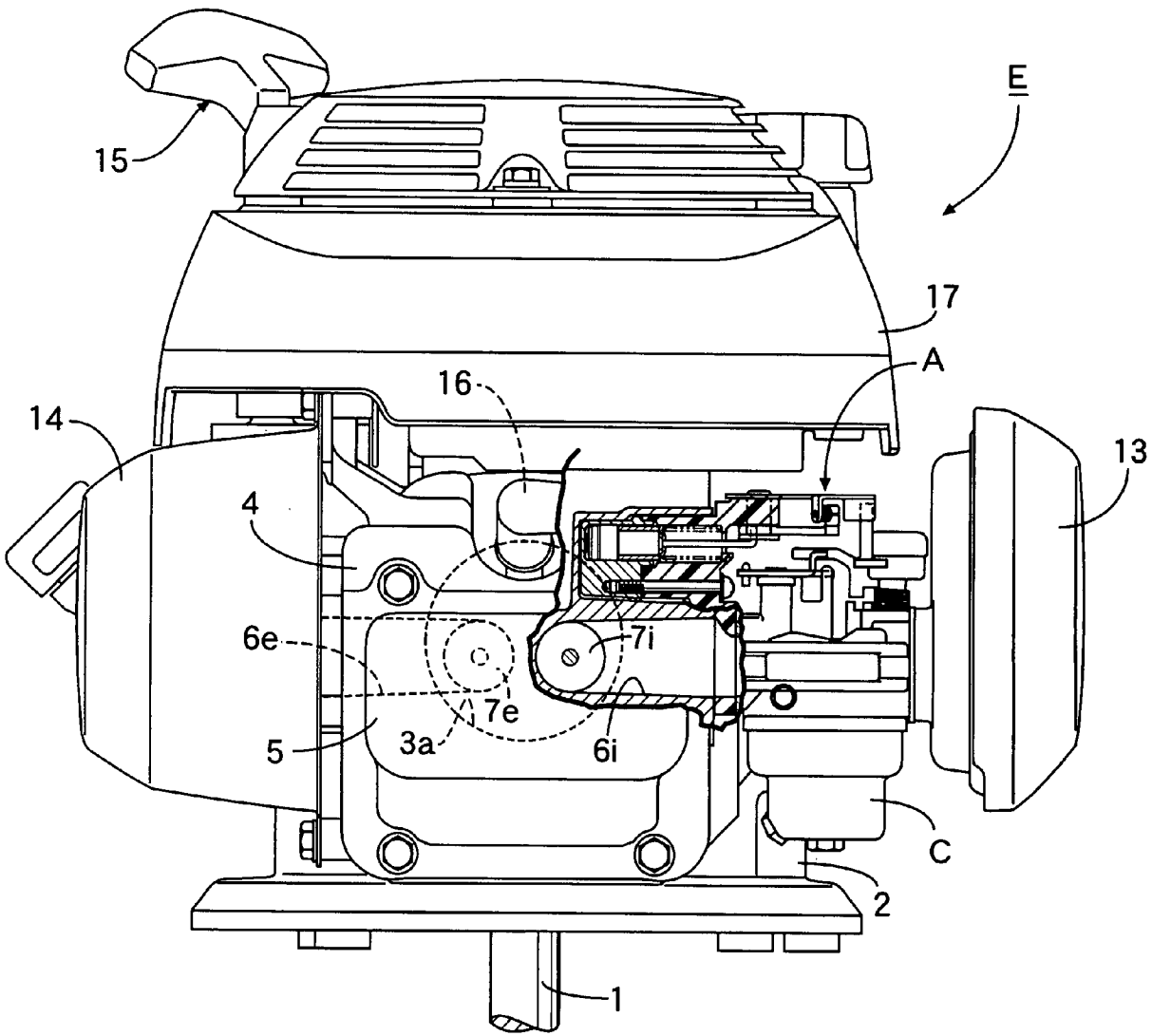
FIG. 1 is a front view of a general purpose engine according to the present invention in which a portion is vertically sectioned.
Figure 2:
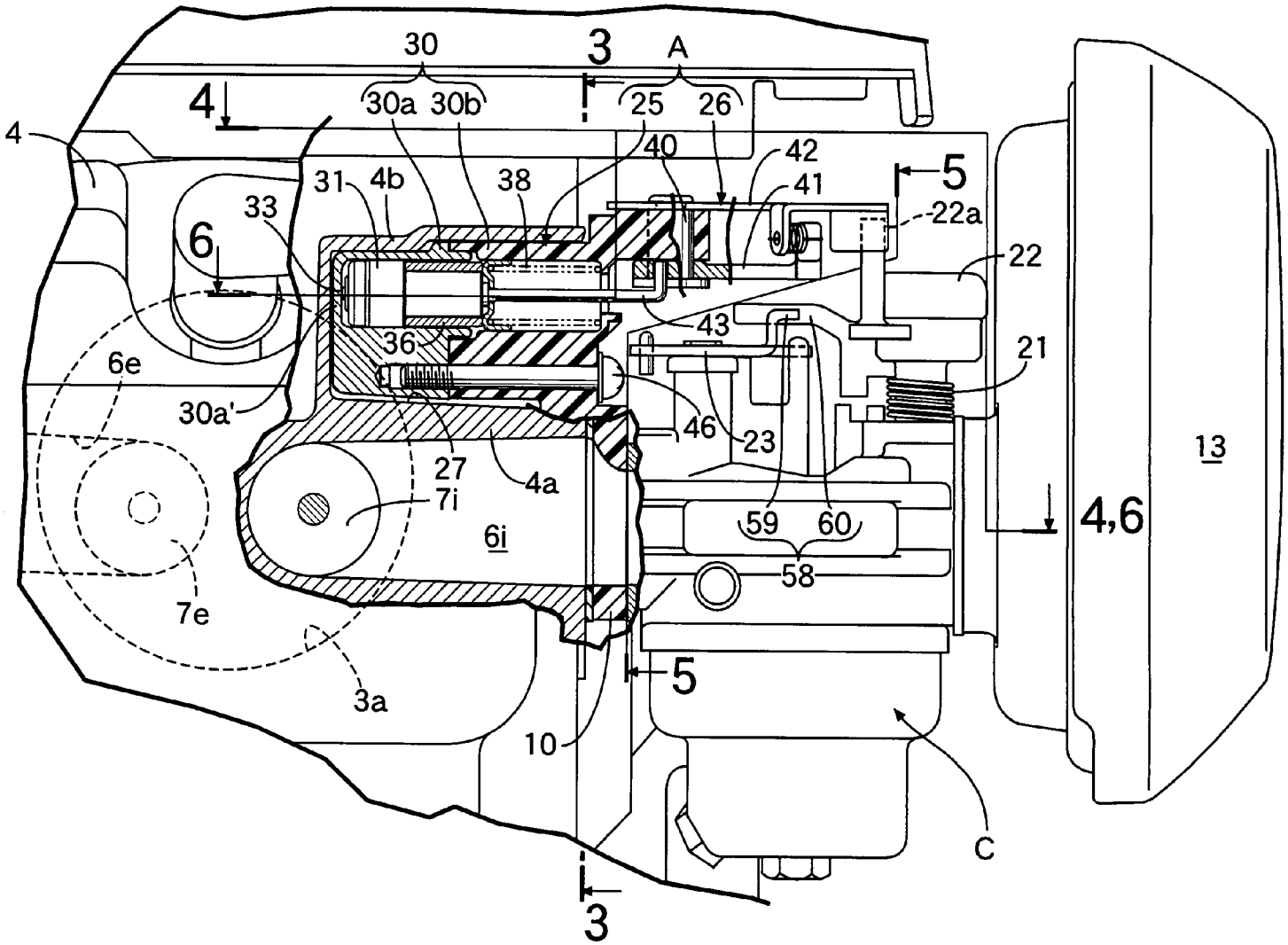
FIG. 2 is an enlarged view of an essential part in FIG. 1.
Figure 3:
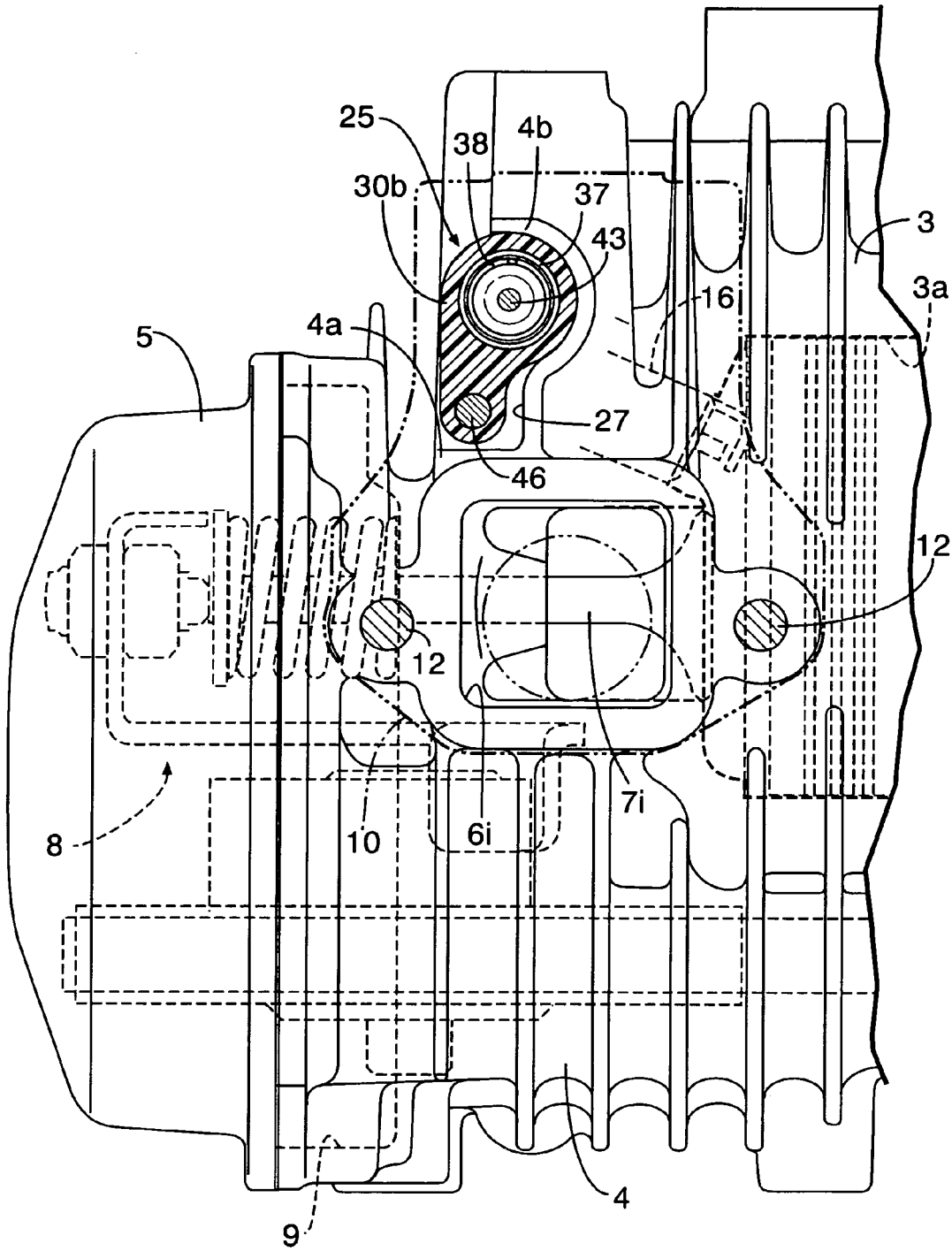
FIG. 3 is a sectional view along line 3-3 in FIG. 2.

In FIG. 1 to FIG. 3, reference symbol E denotes a four-cycle engine, which is a power source for various types of work machine. This engine E includes: a crankcase 2 supporting a vertically disposed crankshaft 1; a cylinder block 3 projecting horizontally from the crankcase 2 and having a cylinder bore 3*a*; and a cylinder head 4 formed integrally with an outer end part of the cylinder block 3. The cylinder head 4 includes: an intake port 6*i* and an exhaust port 6*e*; an intake valve 7*i* and an exhaust valve 7*e* opening and closing the intake port 6*i* and the exhaust port 6*e*, respectively; and a valve operating chamber 9 housing a valve operating mechanism 8 for operating the intake valve 7*i* and the exhaust valve 7*e*. A head cover 5 for closing the valve operating chamber 9, is joined to an end face of the cylinder head 4.

Outer ends of the intake port 6*i* and the exhaust port 6*e* open respectively on one side face and another side face, which face opposite directions to each other, of the cylinder head 4. A carburetor C is joined via a plurality of through bolts 12 to the one side face with a plate-shaped heat-insulating member 10 sandwiched therebetween. The carburetor C includes an intake path 11 communicating with the intake port 6*i*. The heat-insulating member 10 is made of a thermosetting synthetic resin such as a phenol resin having excellent thermal insulation, thereby suppressing heat conduction from the engine E to the carburetor C. An exhaust muffler 14 communicating with the exhaust port 6*e* is mounted on the another side face of the cylinder head 4. A fuel tank 17 and a recoil type starter 15 are disposed in an upper part of the engine E. In FIG. 1, a spark plug 16 is screwed into the cylinder head 4.

Figure 4:
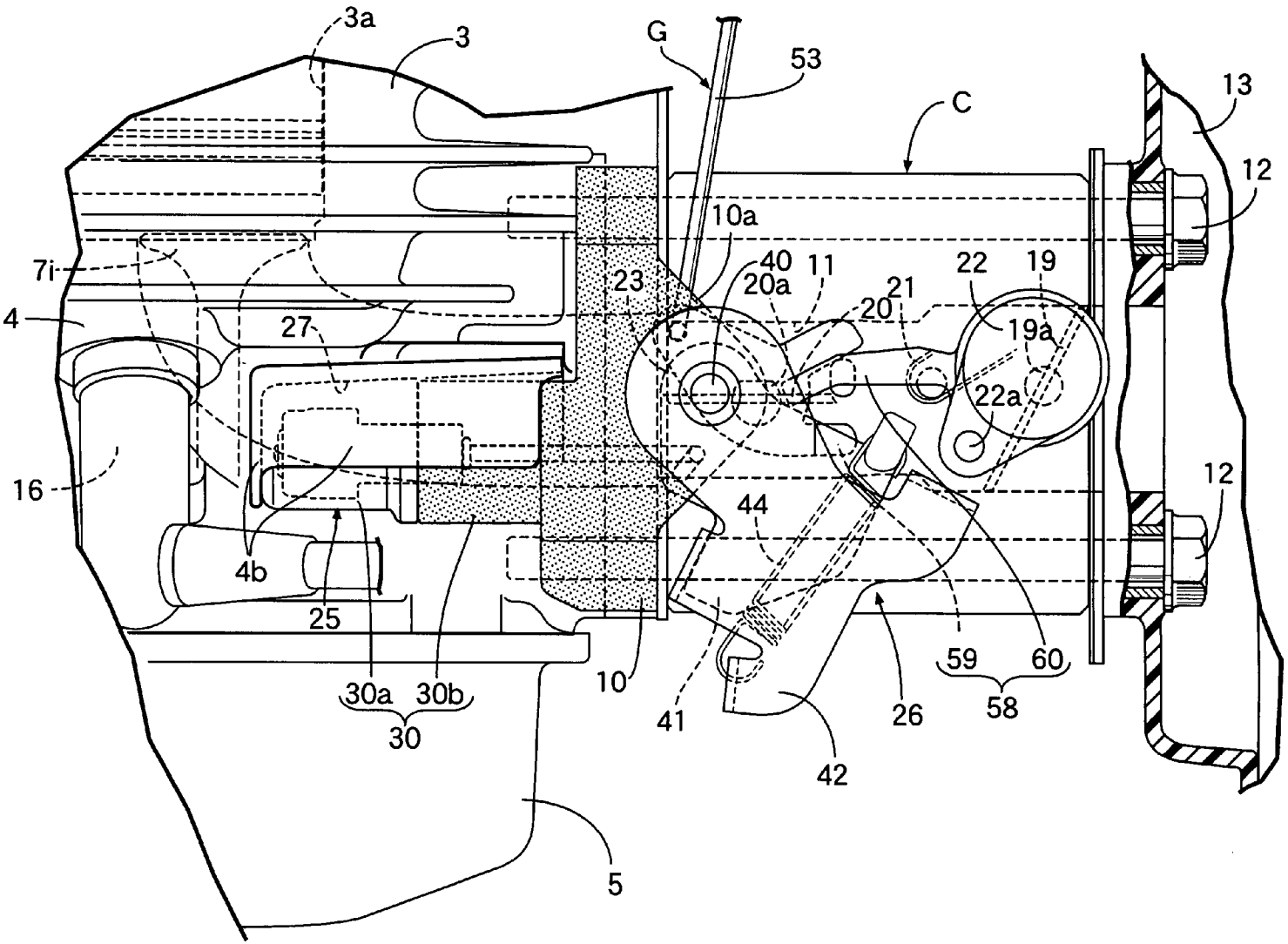
FIG. 4 is a sectional view along 4-4 in FIG. 2.

As shown in FIG. 2 and FIG. 4, the carburetor C is equipped with an air cleaner 13 that communicates with the upstream side of the intake path 11. The intake path 11 of the carburetor C is equipped with a choke valve 19 on the upstream side and a throttle valve 20 on the downstream side, and also with a fuel nozzle (not illustrated) that opens between the two valves 19 and 20. Both the choke valve 19 and the throttle valve 20 are of a butterfly type, that is, they are supported respectively on valve shafts 19*a* and 20*a* rotatably supported in the carburetor C.

In FIG. 4, the valve shaft 19*a* of the choke valve 19 is disposed offset to one side from the center line of the intake path 11. The choke valve 19 is inclined relative to the center axis of the intake path 11 so that, when the choke valve 19 is in a fully closed state, a side thereof having a larger rotational radius is on the downstream side of the intake path 11 relative to a side thereof having a smaller rotational radius. A choke lever 22 is mounted on an outer end part of the valve shaft 19*a* projecting outside the carburetor C. The choke lever 22 is formed into a hollow cylindrical shape relatively rotatably fitted into the valve shaft 19*a*, the interior thereof being coupled to the valve shaft 19*a* via a known relief spring (not illustrated). Fully open and fully closed positions of the choke valve 19 are defined by the choke lever 22 abutting against a stopper (not illustrated) provided on an outside wall of the carburetor C.

When the choke valve 19 is fully closed or at a small degree of opening, if the intake negative pressure of the engine E exceeds a predetermined value, the choke valve 19 opens up to a position at which there is a balance between a rotational moment due to the relief spring, and the difference between a rotational moment due to the intake negative pressure acting on the side of the choke valve 19 having a larger rotational radius and a rotational moment due to the intake negative pressure acting on the side of the choke valve 19 having a smaller rotational radius.

Connected to the choke lever 22 is a choke return spring 21 urging the choke lever 22 in a direction that closes the choke valve 19. An automatic choke system A is disposed so as to oppose the choke lever 22 and automatically control the degree of opening of the choke valve 19 according to a change in temperature of the engine E.

This automatic choke system A is explained by reference to FIG. 2 to FIG. 11.

Referring to FIG. 2 to FIG. 6, the automatic choke system A includes a temperature sensitive section 25 that receives heat from the cylinder head 4 of the engine E, in particular the area around the intake port 6*i*; and an output section 26 that provides a connection between the temperature sensitive section 25 and the choke lever 22, and transmits a heat-receiving operation of the temperature sensitive section 25 to the choke lever 22 as movement in a direction to open the choke valve 19. The temperature sensitive section 25 has a cylindrical housing 30 disposed in a housing chamber 27 formed in the cylinder head 4 by a peripheral wall 4*a* of the intake port 6*i* and a surrounding wall 4*b* rising up from an upper part of the peripheral wall 4*a* (see FIG. 2 and FIG. 3). The housing chamber 27 has one end that opens, as an inlet, on one side face of the cylinder head 4 in the same manner as for the intake port 6*i*, and a closed end part on the opposite side facing the center of the cylinder head 4. Furthermore, one side of the housing chamber 27 is appropriately opened while taking into consideration the moldability of the surrounding wall 4*b* and the assemblability of the temperature sensitive section 25.

The housing 30 includes a cup-shaped first portion 30*a* made of a metal having excellent thermal conductivity such as Al and having a base part 30*a*'; and a cylindrical second portion 30*b* that is made of a synthetic resin having excellent thermal insulation such as a phenol resin and that is fitted in a telescoping manner into an open end of the first portion 30*a* and connected thereto via a screw 46 (see FIG. 2). The second portion 30*b* is connected integrally to the heat-insulating member 10 disposed between the cylinder head 4 and the carburetor C. Therefore, the housing 30 is mounted on the cylinder head 4 without requiring a piece used exclusively for mounting.

The first portion 30*a* is disposed so that the base part 30*a*' faces the interior side of the housing chamber 27, that is, a central part (high temperature part) of the cylinder head 4, and the base part 30*a*' and the peripheral wall are in contact with an inner face of the housing chamber 27 or face it across a very small gap. The second portion 30*b* is disposed on the inlet side of the housing chamber 27, that is, the side away from the center of the cylinder head 4.

Figure 10:
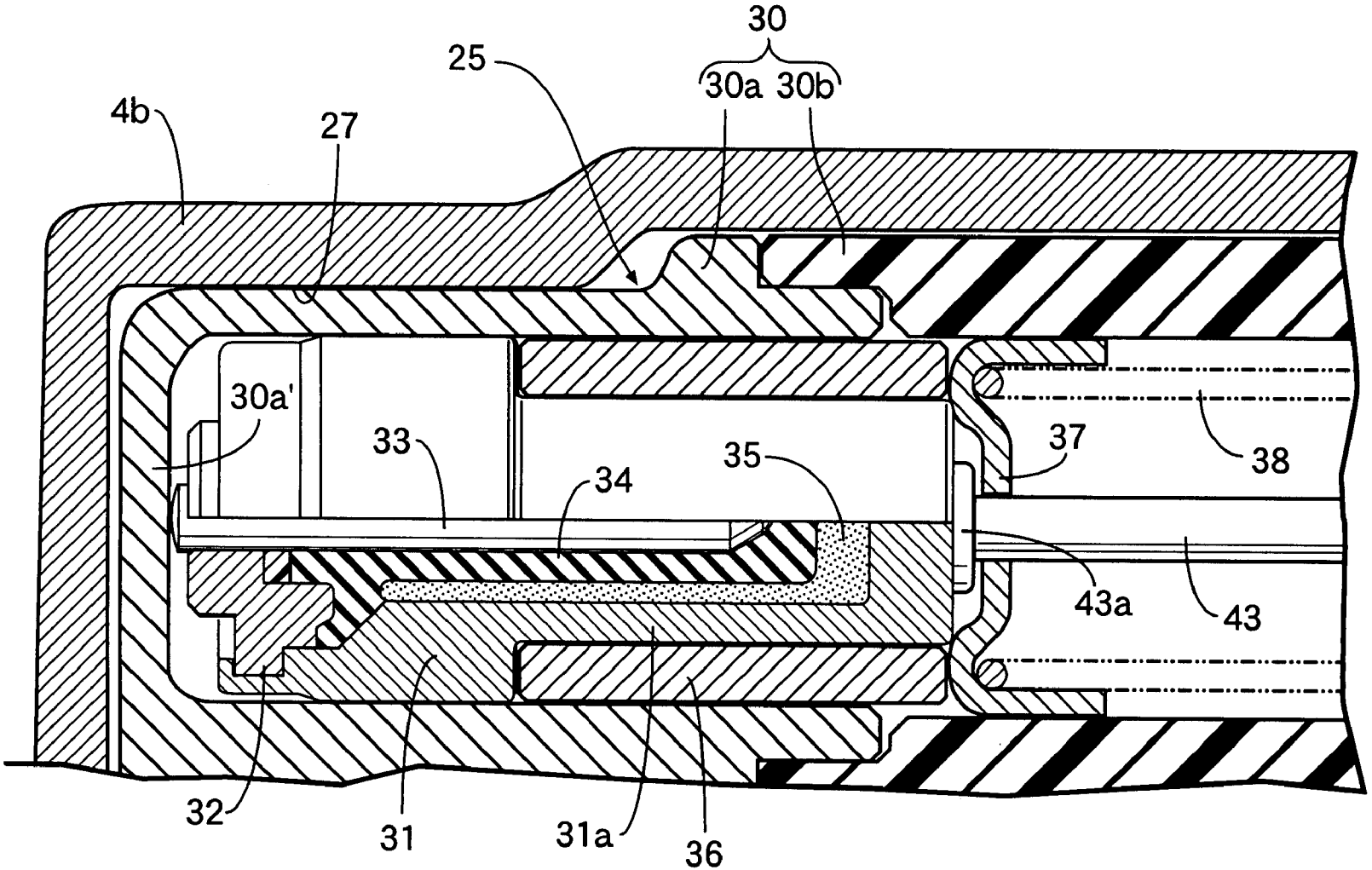
FIG. 10 is an enlarged view of a temperature sensitive section of the automatic choke system in FIG. 6.
Figure 11:
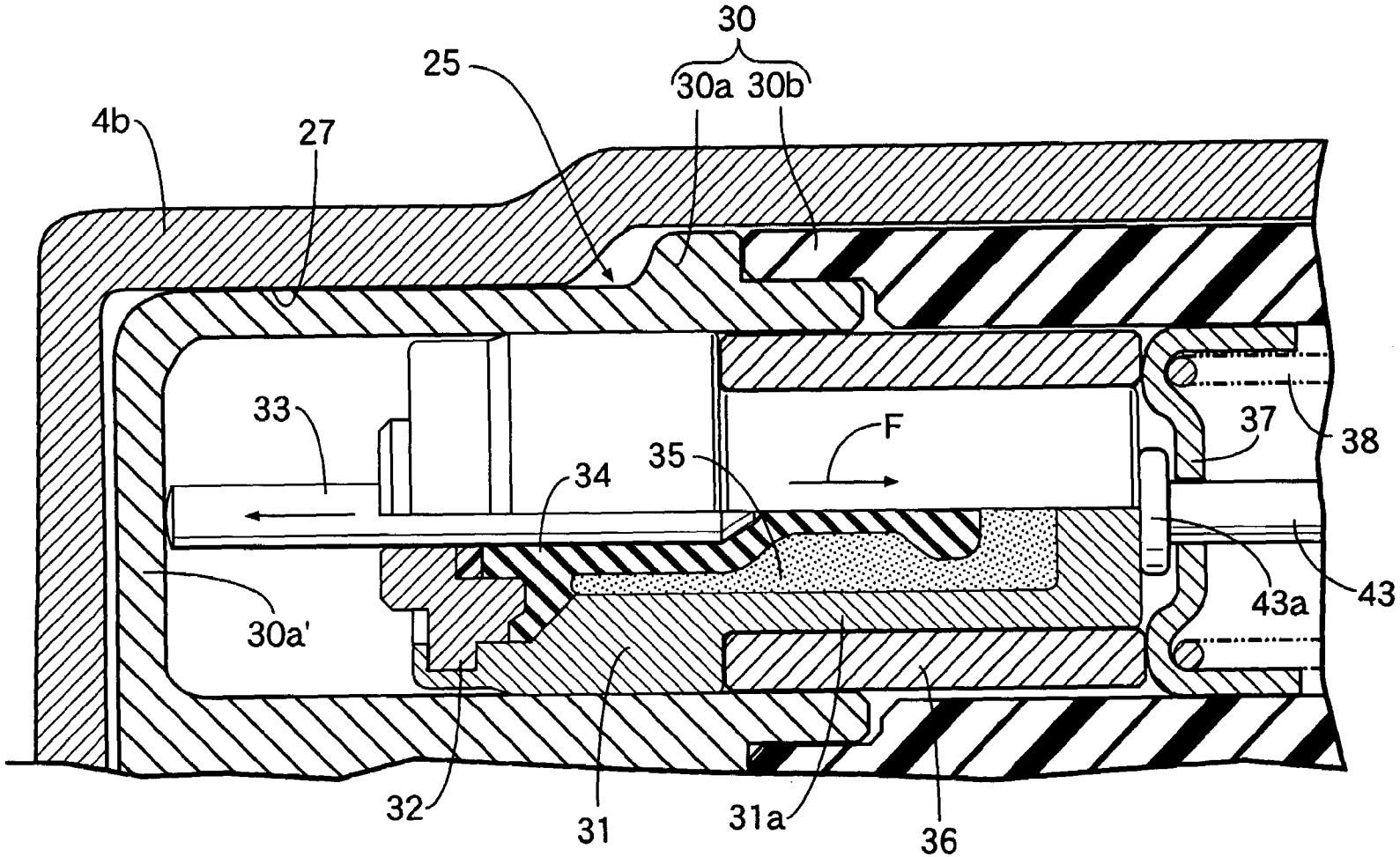
FIG. 11 is a diagram, corresponding to FIG. 10, for explaining the operation.

As shown in FIG. 10, the temperature sensitive section 25 includes a bottomed movable cylinder 31 made of a metal having excellent thermal conductivity such as Al, a guide member 32 joined by crimping to an open end of the movable cylinder 31, and a rod-shaped fixed piston 33 slidably supported in the guide member 32 and running therethrough. An elastic bag 34 having an open end is held in a liquid-tight manner between the movable cylinder 31 and the guide member 32 while covering the fixed piston 33 within the movable cylinder 31; and wax 35 is enclosed in the interior of the movable cylinder 31 so as to cover the elastic bag 34. The movable cylinder 31 is slidably fitted within the first portion 30*a* of the housing 30 in a state in which the outer end of the fixed piston 33 abuts against an inner face of the base part 30*a*' of the first portion 30*a* of the housing 30.

When the wax 35 is heated, it expands and compresses the elastic bag 34 so as to squeeze it, and consequently attempts to push the fixed piston 33 outside the guide member 32, but since the fixed piston 33 having the outer end abutting against the inner face of the base part 30*a*' of the first portion 30*a* is immovable, by virtue of the reaction thereof, the movable cylinder 31 advances within the first portion 30*a* in the direction of arrow F (see FIG. 11), that is, in a direction in which it moves away from the base part 30*a*'.

The half of the outer peripheral face of the movable cylinder 31 on the side opposite to the guide member 32 has a smaller diameter. A distance collar 36 is fitted around this smaller diameter part 31*a*, and a coil-shaped return spring 38 is provided under compression between the heat-insulating member 10 and a retainer 37 abutting against the distance collar 36. The return spring 38 urges, via the distance collar 36, the movable cylinder 31 toward the outer end of the fixed piston 33. Therefore, the retainer 37 is held between the distance collar 36 and the return spring 38.

Figure 5:
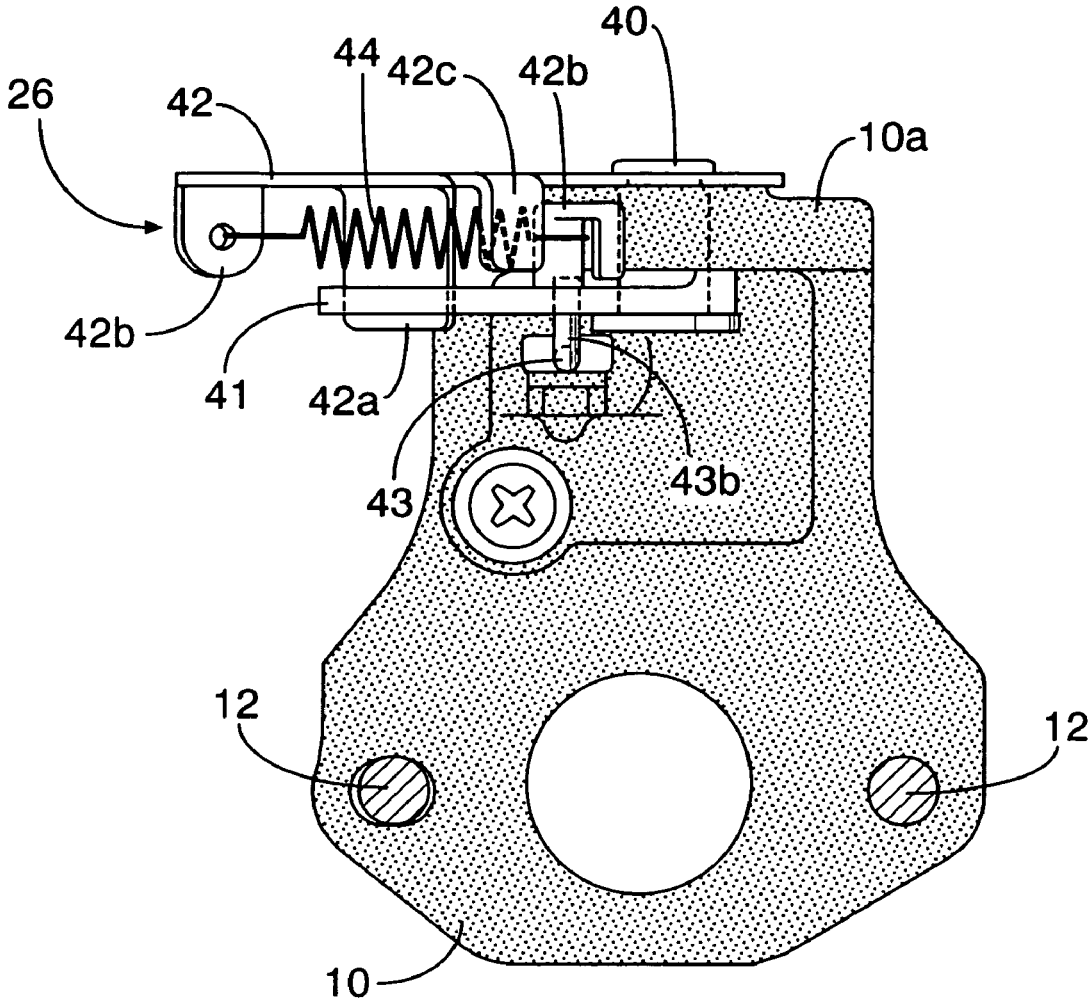
FIG. 5 is a sectional view along line 5-5 in FIG. 2.
Figure 6:
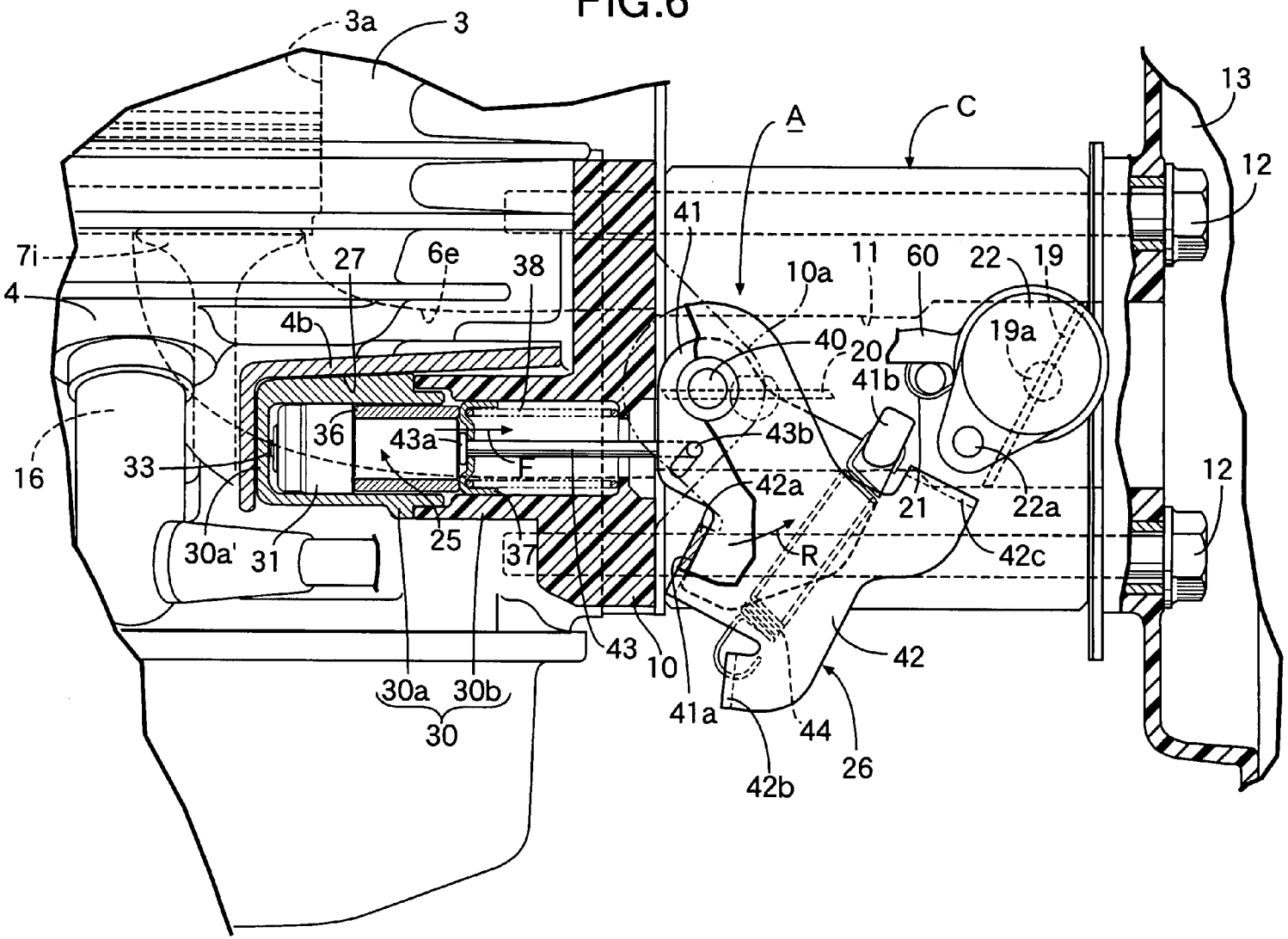
FIG. 6 is a sectional view along line 6-6 in FIG. 2.

As shown in FIG. 5 and FIG. 6, the output section 26 includes a rod 43 running through the heat-insulating member 10 and coupling one end part 43*a* to the retainer 37. First and second levers 41 and 42 are supported, via a common pivot 40, on opposite sides of a bracket 10*a* formed integrally with the heat-insulating member 10 so that they can pivot individually. Another end part 43*b* of the rod 43 is bent into an L shape and is connected to the first lever 41, and it is arranged so that the first lever 41 pivots in the direction of arrow R in FIG. 6 as a result of the axial movement of the rod 43 accompanying forward movement F of the movable cylinder 31. Coupling of the rod 43 to the retainer 37 is achieved by holding an enlarged end part 43*a* at one end of the rod 43 between the retainer 37 and an end face of the movable cylinder 31.

The first and second levers 41 and 42 have abutment parts 41*a* and 42*a* that separably abut against each other along the pivotal direction of the two, and these abutment parts 41*a* and 42*a* move away from each other when the first lever 41 pivots in the direction of the arrow R relative to the second lever 42. The first and second levers 41 and 42 are provided with spring latching parts 41*b* and 42*b*, and opposite ends of a coupling spring 44 are latched onto these spring latching parts 41*b* and 42*b*, the coupling spring 44 urging the two levers 41 and 42 in a direction in which the abutment parts 41*a* and 42*a* abut against each other.

Formed integrally with the second lever 42 is an operating arm 42*c* that operatively faces a passive pin 22*a* of the choke lever 22. When the second lever 42 pivots in the direction of the arrow R, the operating arm 42*c* makes the choke lever 22 pivot in a direction to open the choke valve 19.

Figure 12:
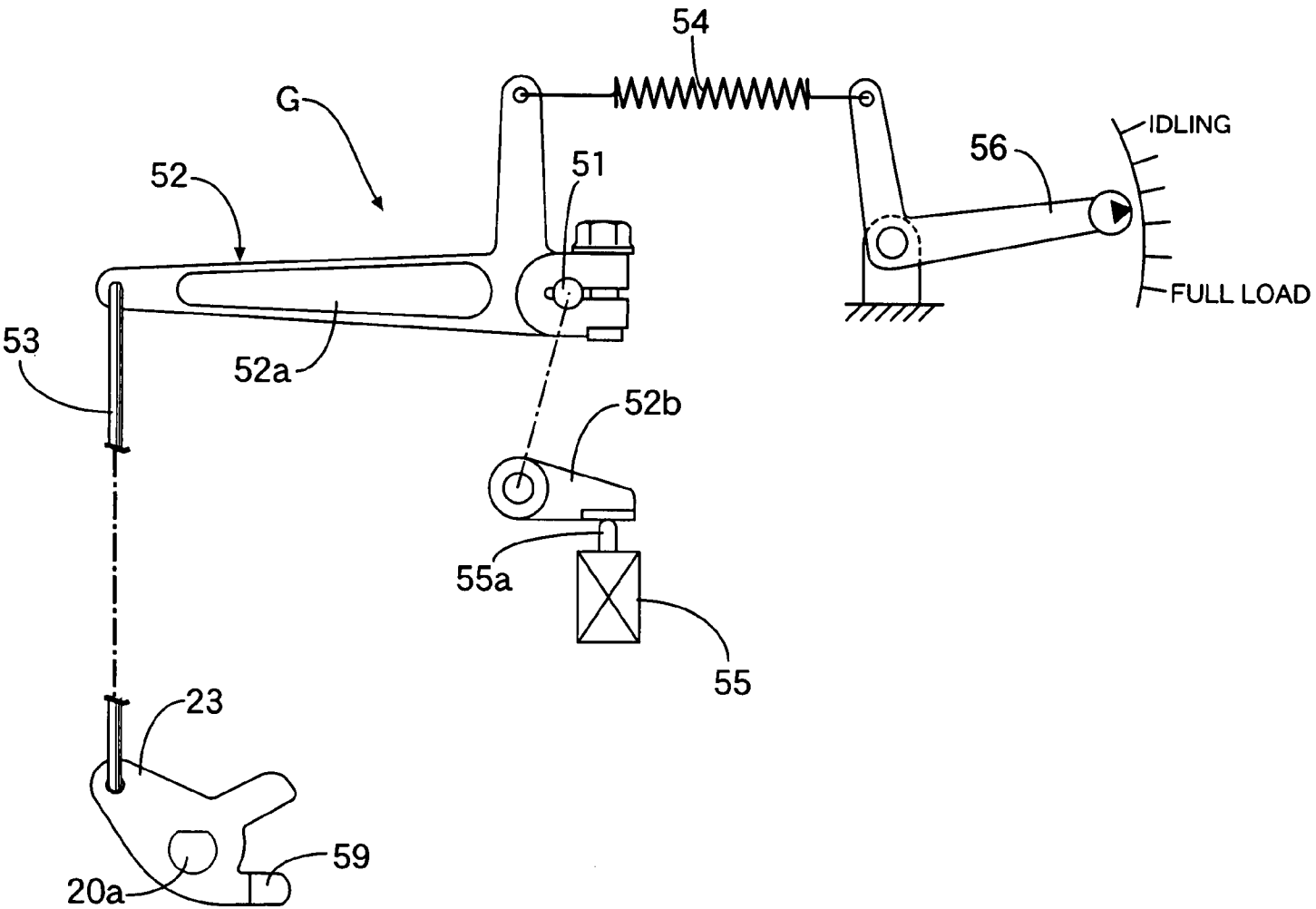
FIG. 12 is a schematic side view of a governor system.

In FIG. 12, a governor system G for automatically controlling opening and closing of the throttle valve 20 is explained. A throttle lever 23 is secured to an outer end part of the valve shaft 20*a* of the throttle valve 20. A governor lever 52 is secured to the outer end of a rotating support shaft 51 supported on the engine E. A long arm portion 52*a* of the governor lever 52 is coupled to the throttle lever 23 via a link 53. Furthermore, coupled via a governor spring 54 to the governor lever 52 is an output control lever 56 that is supported on the engine E, etc. and can pivot through a range from an idling position to a full load position. The governor spring 54 always urges the throttle valve 20 in the opening direction, and its spring load is increased and decreased by pivoting the output control lever 56 from the idling position to the full load position, or vice versa.

Further, an output shaft 55*a* of a known centrifugal governor 55 driven by the crankshaft 1 of the engine E, is connected to a short arm portion 52*b* of the governor lever 52. The output of the centrifugal governor 55, which increases in response to an increase in the rotational speed of the engine E, acts on the short arm portion 52*b* in a direction to close the throttle valve 20.

Therefore, in a state in which running of the engine E is stopped, the throttle lever 23 is held by means of a set load of the governor spring 54 at position C in which the throttle valve 20 is closed, but during running of the engine E, the degree of opening of the throttle valve 20 is automatically controlled by the balance between the moment of the governor lever 52 due to the output of the centrifugal governor 55 and the moment of the governor lever 52 due to the set load of the governor spring 54.

Figure 13:
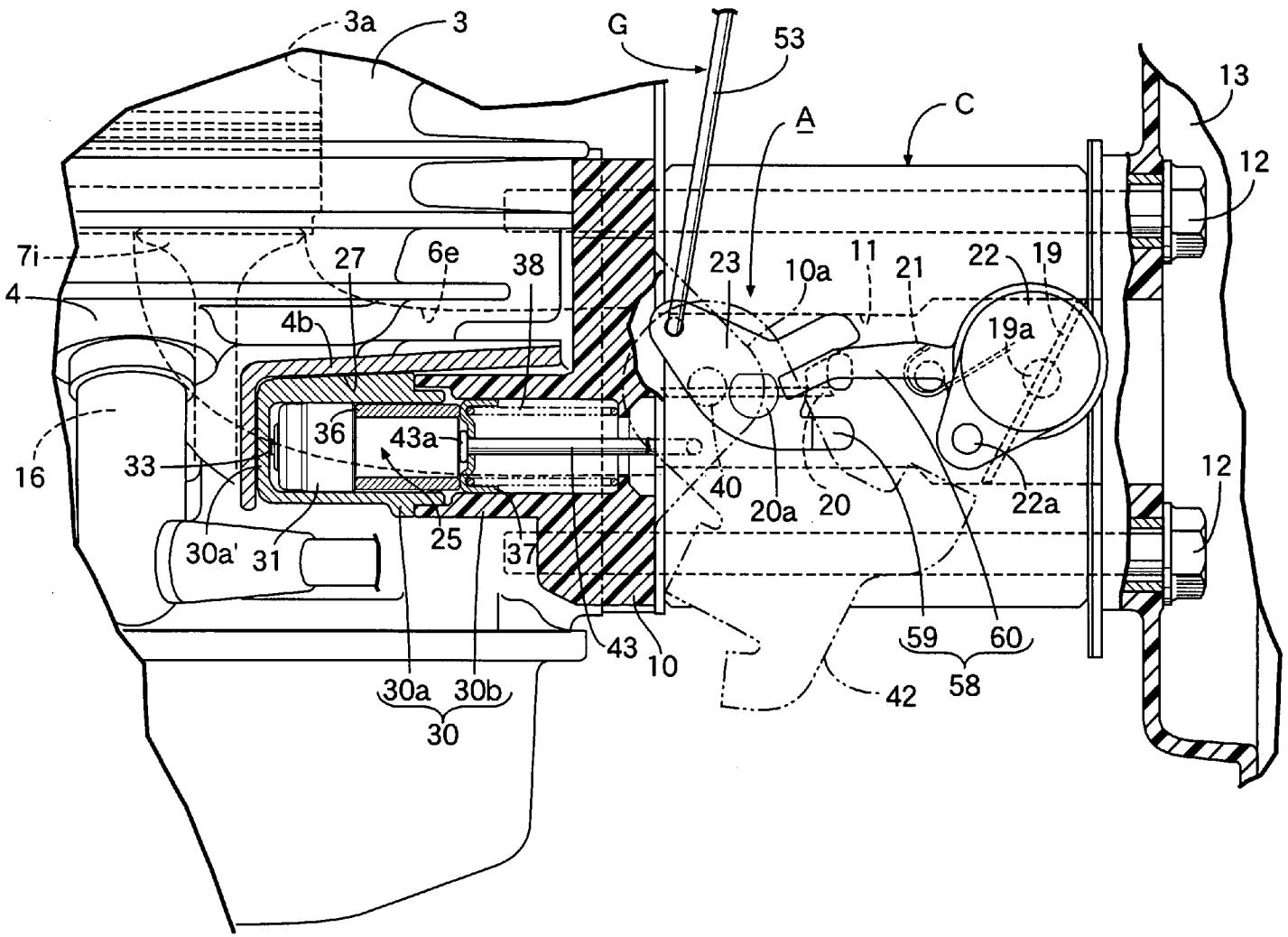
FIG. 13 is a side view of a section around throttle valve closure restricting means.
Figure 14:
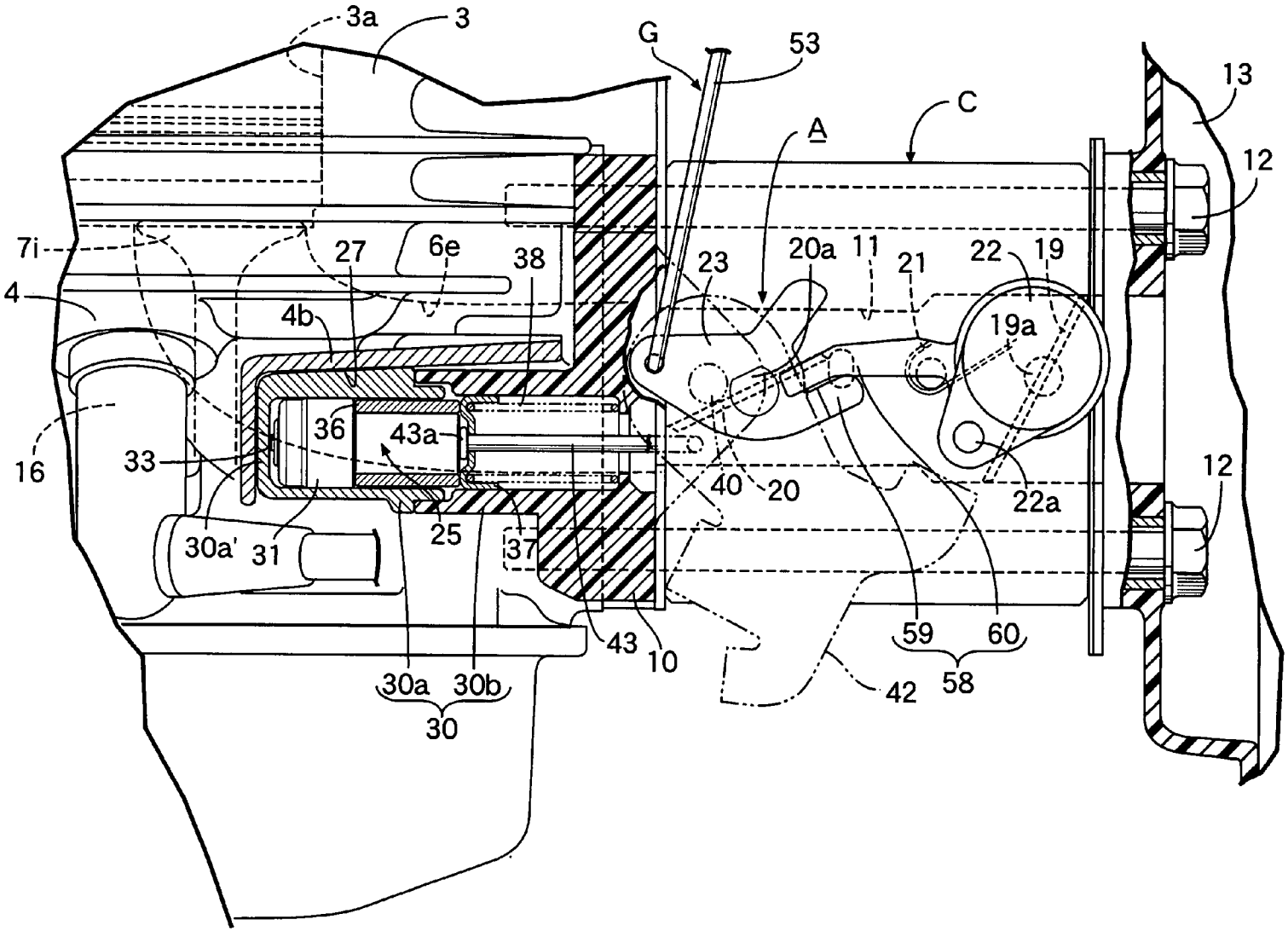
FIG. 14 is a diagram, corresponding to FIG. 4, for explaining an operational state of the throttle valve closure restricting means.

Moreover, as shown in FIG. 2, FIG. 13, and FIG. 14, a restricted arm 59 is formed integrally with the throttle lever 23, and a restricting arm 60 corresponding to the restricted arm 59 is formed integrally with the choke lever 22. During warming up of the engine E, when the throttle valve 20 is closed by the output control lever 56 adjusting the spring force of the governor spring 54 to zero or a minimum, the restricting arm 60 receives the restricted arm 59 by means of the spring force of the choke return spring 21 (see FIG. 14), so that closing of the throttle valve 20 is restricted to a predetermined first degree of opening for idling that is greater than a normal degree of opening for idling. The restricted arm 59 and restricting arm 60 form throttle valve closure restricting means 58 of the present invention.

The operation of this embodiment is now explained.

In a state in which the engine E is cold or stopped, as shown in FIG. 10, since the wax 35 in the temperature sensitive section 25 is in a contracted state, the movable cylinder 31 is held at a retracted position in proximity to the base part 30*a*' of the first portion 30*a* of the housing 30 by means of the resilient force of the return spring 38. Accompanying this, as shown in FIG. 6, the operating arm 42*c* of the second lever 42 of the output section 26 is held at a position spaced from the choke lever 22, and therefore the choke lever 22 is held at a position in which the choke valve 19 is closed by means of the urging force of the choke return spring 21.

On the other hand, the throttle valve 20 is held at a fully open position by the governor spring 54 since the centrifugal governor 55 is in an inoperative state (see FIG. 13). If at this time the output control lever 56 is set at the idling position, the load of the governor spring 54 is set to a minimum or zero.

Therefore, in order to start the engine E, if the recoil starter 15 is operated so as to crank the crankshaft 1, a large negative pressure is generated in the intake path 11 downstream of the choke valve 19 in the carburetor C, a relatively large amount of fuel spurts out from the fuel nozzle, which opens at this position, to make a gas mixture formed in the intake path 11 rich, thereby smoothly starting the engine E to start warming up.

When warming up of the engine E is started, the centrifugal governor 55 generates an output corresponding to the rotational speed of the crankshaft 1, so that the governor lever 52 pivots in a direction in which there is a balance between the moment of the governor lever 52 due to the above output and the moment of the governor lever 52 due to the spring force of the governor spring 54. In this process, if the output control lever 56 remains at the idling position, in the conventional arrangement the throttle valve 20 would close to the degree of opening for idling, thus making the warming up unstable. However, in the present invention, as shown in FIG. 14, in a process of closing the throttle valve 20, due to the spring force of the choke return spring 21, the restricting arm 60 integral with the choke lever 22 receives the restricted arm 59 integral with the throttle lever 23, thus restricting the closing of the throttle valve 20 to the predetermined first degree of opening for idling, which is larger than the normal degree of opening for idling. Therefore, it is possible to guarantee stable warm-up operating conditions for the engine E while keeping the output control lever 56 set at the idle position, which is effective for improvement of the ease of manipulation of the engine E.

During warming up of the engine E, in order to impose a load of a work machine, etc. on the engine E, if the output control lever 56 is pivoted from the idling position to an appropriate load position, the load of the governor spring 54 increases accordingly, so that the degree of opening of the throttle valve 20 when the load of the governor spring 54 and the output of the centrifugal governor 55 are in balance therefore increases. In this process, since the restricted arm 59 pivots in a direction in which it escapes from the restricting arm 60, opening of the throttle valve 20 is not obstructed by the restricting lever 60.

Furthermore, when the intake negative pressure generated downstream of the intake path 11 exceeds a predetermined value accompanying an increase in the degree of opening of the throttle valve 20, the choke valve 19 is opened until the difference between the rotational moment due to the intake negative pressure acting on the side of the choke valve 19 having a larger rotational radius and the rotational moment due to the intake negative pressure acting on the side of the choke valve 19 having a smaller rotational radius, balances the rotational moment due to the relief spring within the choke lever 22. Therefore, it is possible to prevent the gas mixture formed in the intake path 11 from becoming too rich, thus guaranteeing good warm-up operating conditions.

Figure 7:
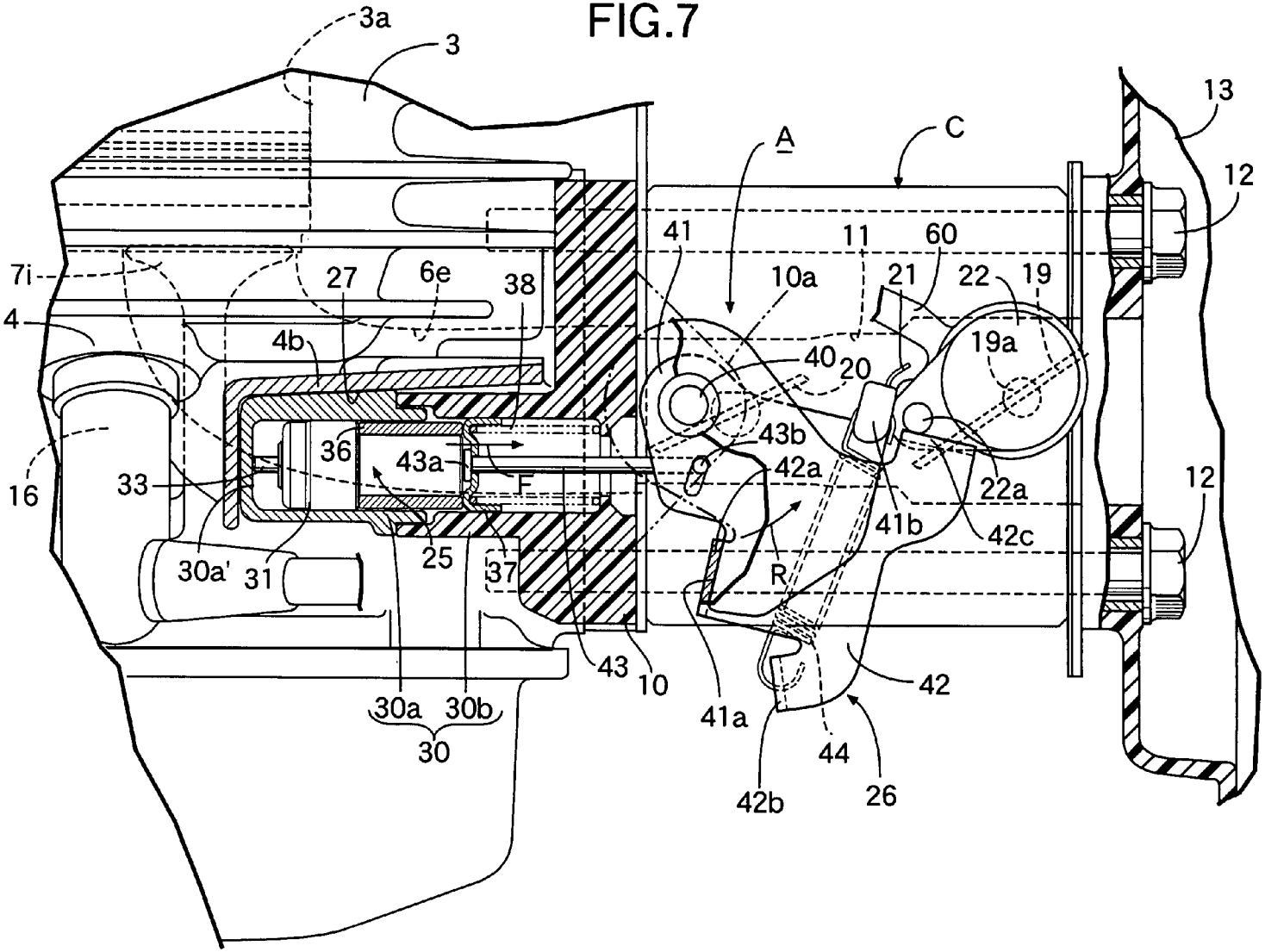
FIG. 7 is a diagram, corresponding to FIG. 6, for explaining the operation of an automatic choke system.

When the temperature of the cylinder head 4 increases accompanying progress in the warming up of the engine E, the temperature sensitive section 25 within the housing chamber 27 in the proximity of the intake port 6*i* is heated via an inner wall of the housing chamber 27. As described above, the reaction to the elastic bag 34 being constricted to push out the fixed piston 33 due to thermal expansion of the wax 35 within the movable cylinder 31, makes the movable cylinder 31 move forward in the direction of the arrow F against the resilient force of the return spring 38. This forward movement of the movable cylinder 31 pivots the first lever 41 via the rod 43 in the direction of the arrow R. Since this first lever 41 and the second lever 42 are initially in a coupled state in which the abutment parts 41*a* and 42*a* abut against each other due to the urging force of the coupling spring 44, as shown in FIG. 7, the second lever 42 also pivots integrally with the first lever 41, and the operating arm 42*c* makes the passive pin 22*a*, that is, the choke lever 22, pivot against the urging force of the choke return spring 21 in a direction that opens the choke valve 19.

Figure 8:
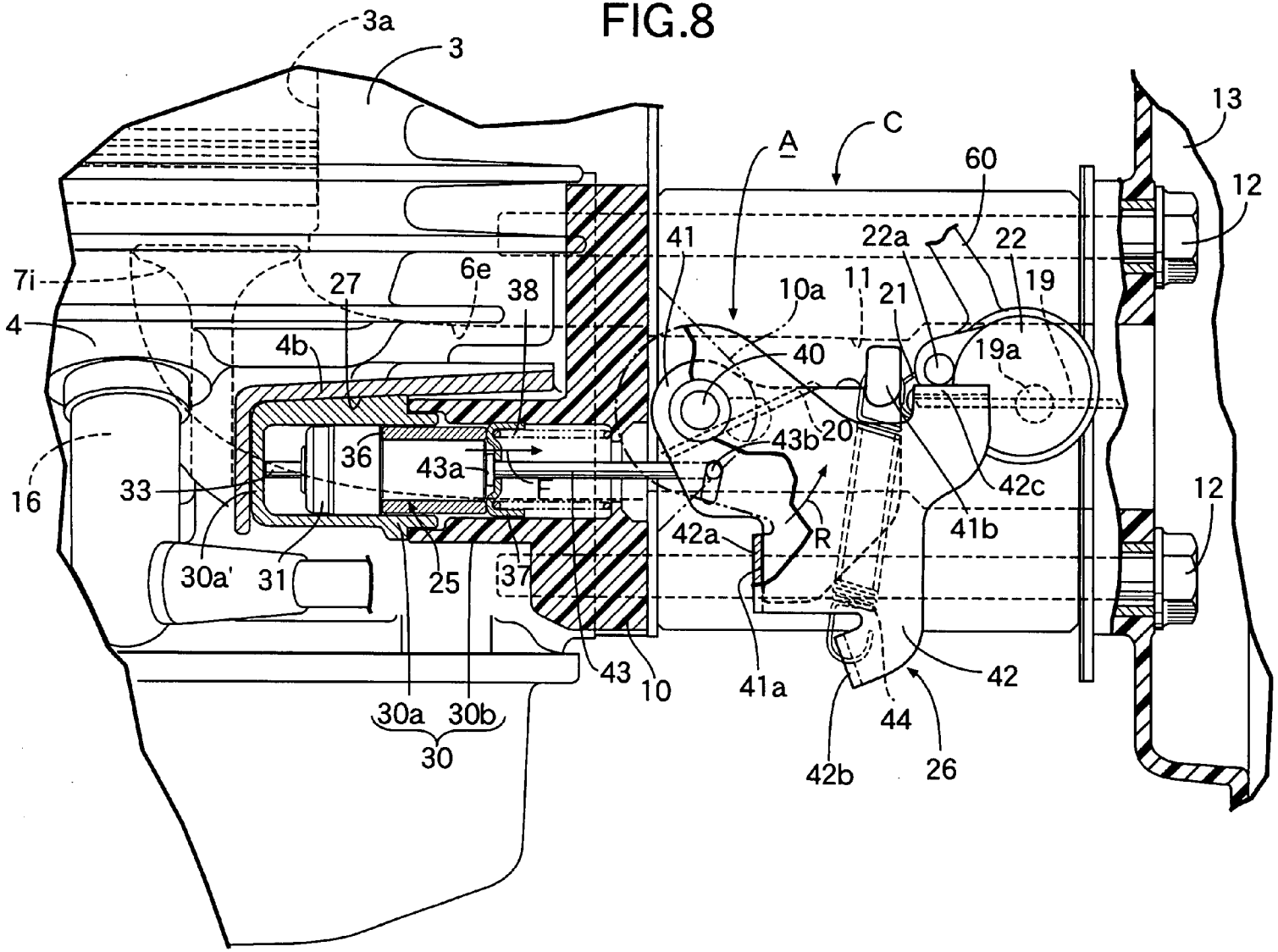
FIG. 8 is another diagram for explaining the operation of the automatic choke system.

Therefore, since the degree of opening of the choke valve 19 increases in response to an increase in the temperature of the housing chamber 27, the negative pressure above the fuel nozzle within the intake path 11 is decreased accompanying progress in the warming up of the engine E, the amount of fuel spurting out from the fuel nozzle is decreased, and the air/fuel ratio of the gas mixture formed in the intake path 11 can be appropriately corrected. About time when the warming up of the engine E is completed, the temperature of the interior of the housing chamber 27 is sufficiently high, and as shown in FIG. 8, the choke valve 19 is controlled so as to be in a fully open state.

Figure 15:
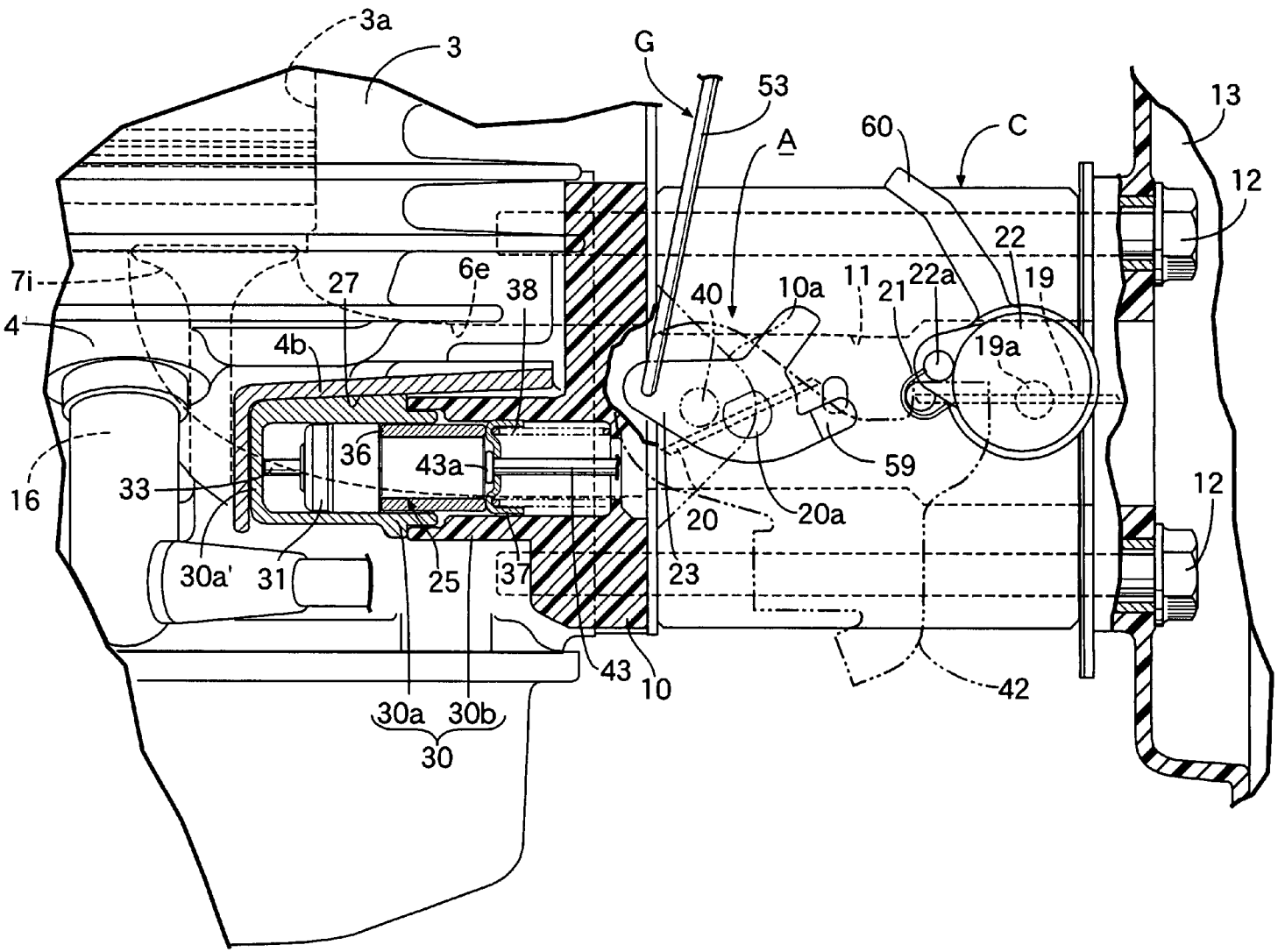
FIG. 15 is a diagram for explaining an inoperative state of the throttle valve closure restricting means.

As hereinbefore described, when the choke valve 19 is opened by the choke lever 22, the restricting arm 60 of the choke lever 22 moves away from the restricted arm 59 of the throttle lever 23 as shown in FIG. 15, and the two arms 59 and 60 do not interfere with each other. Therefore, if the output control lever 56 is returned to the idling position to control the load of the governor spring 54 at zero or a minimum after the warming up is completed, the throttle lever 23 can be pivoted to the degree of opening for idling of the throttle valve 20 by means of the output of the centrifugal governor 55. Thus, it is unnecessary to employ a special operation for canceling the operation of the throttle valve closure restricting means 58, and the ease of manipulation the engine is further improved.

Figure 9:
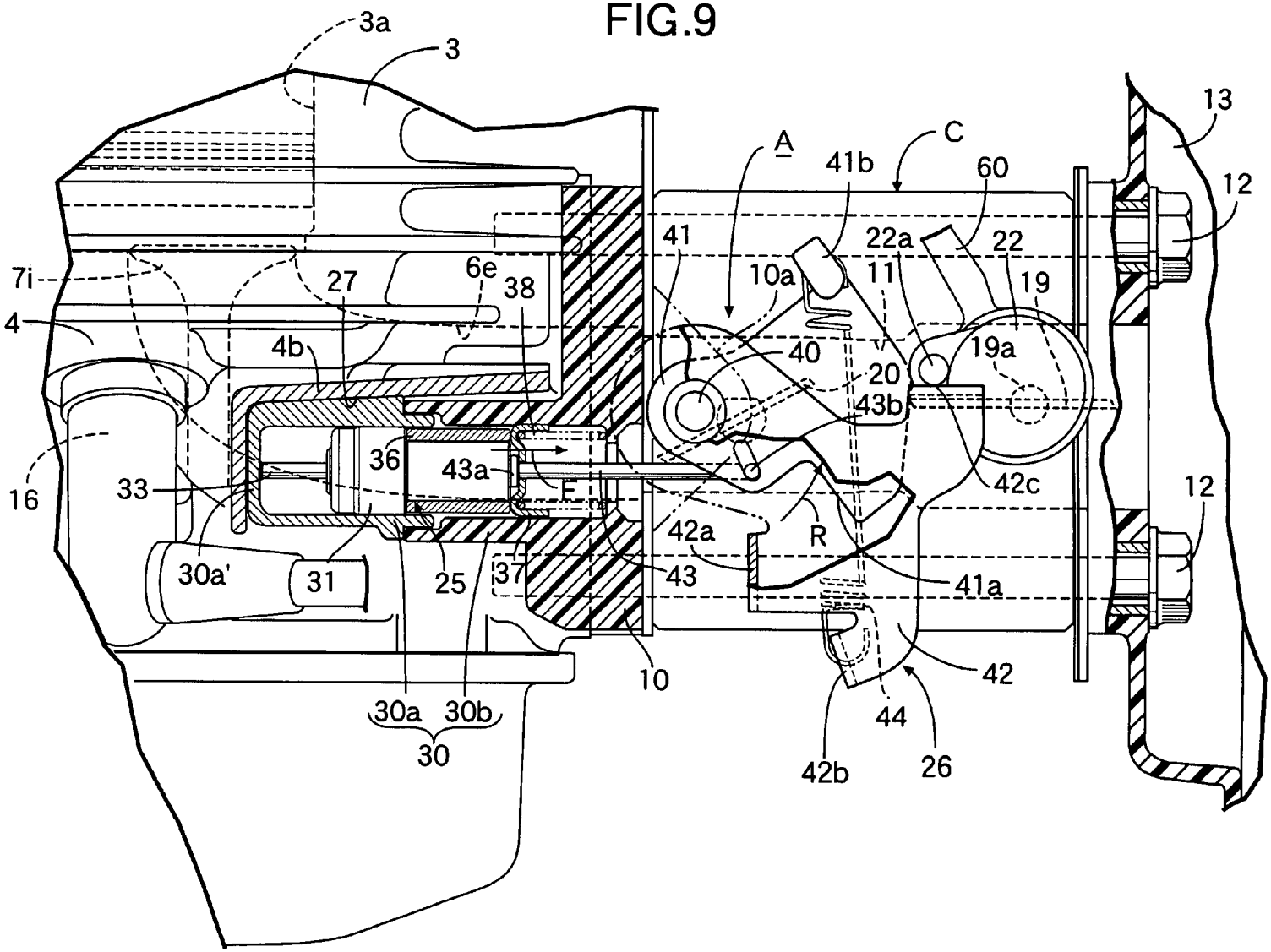
FIG. 9 is a yet another diagram for explaining the operation of the automatic choke system.

When the temperature of the cylinder head 4 further increases and the temperature of the housing chamber 27 increases, the wax 35 further thermally expands, and the movable cylinder 31 moves forward excessively to thus further pivot the first lever 41 in the direction of the arrow R via the rod 43. However, since further pivoting of the second lever 42 is inhibited by the choke lever 22 at the fully open position, as shown in FIG. 9, the first lever 41 alone pivots in the direction of the arrow R while stretching the coupling spring 44, and the abutment part 41*a* of the first lever 41 moves away from the abutment part 42*a* of the second lever 42. Therefore, an over stroke operation of the movable cylinder 31 of the temperature sensitive section 25 is absorbed by the stretching of the coupling spring 44. This means that no section from the automatic choke system A to the choke valve 19 experiences a load that is higher than the set load of the coupling spring 44. This avoids the occurrence of excessive stress in each section to secure the durability of each section. Moreover, since the first and second levers 41 and 42, which can pivot relative to each other, are mounted on the bracket 10*a* via the common pivot 40, it is possible to reduce the number of components of the output section 26, thus simplifying the structure.

When running of the engine E is subsequently stopped, as long as a high temperature state of the engine E continues, the interior of the housing chamber 27 is kept in a high temperature state, and therefore the temperature sensitive section 25 maintains a state in which the movable cylinder 31 is moved forward, thus maintaining the choke valve 19 in an open state via the output section 26. In this state, since the restricting arm 60 of the choke lever 22 is largely separated from the restricted arm 59 of the throttle lever 23, return of the throttle valve 20 to the fully open position by means of the load of the governor spring 54 is not at all obstructed. When the engine E is restarted in a high temperature state, it is possible to secure an open state of the choke valve 19, prevent the gas mixture from becoming too rich, and achieve good restarting properties.

After running of the engine E is stopped, when it becomes cool, the movable cylinder 31 retracts in the temperature sensitive section 25 as a result of the thermal contraction of the wax 35 and the action of the return spring 38. Therefore, the output section 26 allows pivoting of the choke lever 22 by means of the choke return spring 21 in a direction that closes the choke valve 19.

During running of the engine E, the area around the intake port 6*i* of the cylinder head 4 is always cooled by intake air flowing through the intake port 6*i*, it can have temperature characteristics that are little influenced by variation in the load of the engine E and that correspond to the progress in warming up. Therefore, the temperature sensitive section 25 disposed in the proximity of the intake port 6*i* operates appropriately according to the progress in warming up regardless of variation in the load of the engine E, thereby always correctly controlling the degree of opening of the choke valve 19. This contributes to an improvement in fuel consumption characteristics and emission characteristics of the engine E.

In particular, when the temperature sensitive section 25 is disposed in the housing chamber 27 formed in the cylinder head 4 from the peripheral wall 4*a* of the intake port 6*i* and the surrounding wall 4*b* extending up from one side of the peripheral wall 4*a*, it is possible to adjust the operational characteristics of the temperature sensitive section 25 with respect to the progress in warming up of the engine E by selecting a length of the surrounding wall 4*b* so as to set an appropriate area across which the housing chamber 27 faces the temperature sensitive section 25.

Furthermore, in the bottomed housing 30 of the temperature sensitive section 25, the base part 30*a*' close to the center of the cylinder head 4 receives the largest amount of heat from the cylinder head 4. However, the fixed piston 33 abuts against the inner face of the base part 30*a*'; accompanying thermal expansion of the wax 35, the movable cylinder 31 enclosing the wax 35 moves forward within the housing 30 in the direction to move away from the base part 30*a*'; and the amount of heat the wax 35 within the movable cylinder 31 receives from the housing 30 is therefore large immediately after the engine E starts warming up and decreases as the warming up progresses.

In particular, since the housing 30 is formed from the first portion 30*a*, which has the base part 30*a*' and is made of a metal having high thermal conductivity, and the second portion 30*b*, which is on the side opposite to the base part 30*a*' and is highly thermally insulating, the above-mentioned trend in the heat receiving characteristics of the wax 35 can further be enhanced. That is, when advancing, the movable cylinder 31 moves toward the second portion 30*b* side, which is highly thermally insulating, so that the heat received by the wax 35 is further decreased. As a result, immediately after warming up of the engine E is started, the wax 35 within the movable cylinder 31 quickly receives heat from the first portion of the housing 30 and starts to expand, thus hastening opening of the choke valve 19 and suppressing effectively the gas mixture from becoming too rich. Furthermore, since the movable cylinder 31 moves from the first portion 30*a* of the housing 30 to the second portion 30*b* as warming up progresses, the heat received by the wax 35 within the movable cylinder 31 from the housing 30 can be reduced effectively as the warming up progresses. Therefore, the speed of opening of the choke valve 19 is reduced appropriately as completion of the warming up is approached, and more stable warming up can be continued. Moreover, after the completion of warming up, since the heat received by the wax 35 is further decreased, this can further contribute to prevention of degradation of the wax 35 by overheating.

Furthermore, since the housing 30 is formed from the first portion 30*a* which has the base part 30*a*' and good thermal conduction, and the second portion 30*b* which is joined to the first portion on the side opposite to the base part 30*a*' and is thermally insulating, the heat generated by the engine E is mainly transmitted to the wax 35 within the movable cylinder 31 via the first portion 30*a*. Therefore, the characteristics of the temperature sensitive section 25 can be changed by selecting the shape and position of the first portion 30*a* alone, this enables application to various types of engine E.

Moreover, since the second portion 30*b* which is highly thermally insulating, and the bracket 10*a* which axially supports the first lever 41 of the output section 26, are molded integrally with the heat-insulating member 10 disposed between the cylinder head 4 and the carburetor C, the housing 30 of the temperature sensitive section 25 and the bracket 10*a* can be supported on the cylinder head 4 without employing a support member used exclusively therefor, thereby reducing the number of components and simplifying the structure and contributing to a reduction in the cost of the automatic choke system A.

The present invention is not limited to the above-mentioned embodiment, and can be modified in a variety of ways as long as the modifications do not depart from the spirit and scope thereof. For example, instead of the centrifugal governor 55, another type of governor may be provided. Furthermore, the movable cylinder 31 may be made as a fixed cylinder to abut against the base part 30*a*' of the first portion 30*a* of the housing 30, and the fixed piston 33 may be coupled as a movable piston to the retainer 37 or the rod 43, thereby moving the piston 33 forward when the wax 35 thermally expands.

The invention claimed is:

1. A carburetor throttle valve control system for controlling the throttle valve of an engine carburetor, said throttle valve control system comprising:

a throttle lever for opening and closing the throttle valve;

a governor system coupled to the throttle lever, the governor system including:

(i) a governor spring operatively coupled to the throttle lever for exerting a spring force on the throttle lever in a direction to open the throttle valve;

(ii) an output control member for adjusting the spring force of said governor spring; and (iii) a governor for exerting an output on the throttle lever in a direction to close the throttle valve, and for increasing the output in response to an increase in the rotational speed of the engine;

a choke valve on the carburetor;

a choke lever;

a choke return spring connected to the choke lever for opening and closing the choke valve, the choke return spring urging the choke lever towards the choke valve closing side; and throttle valve closure restricting means operatively coupled between the throttle lever and the choke lever, wherein during warm-up of the engine, the throttle valve closure restricting means restricts the choke lever closing of the throttle valve when the spring force of the governor spring is adjusted to zero or a minimum by the output control member.

2. The carburetor throttle valve control system according to claim 1, wherein the throttle valve closure restricting means comprises a restricted arm formed on the throttle lever and a restricting arm formed on the choke lever, wherein during warming up of the engine, the throttle valve restricting means abuts against the restricted arm when the spring force of the governor spring is adjusted to zero or a minimum by the output control member thereby restricting the closing of the throttle valve.

3. The carburetor throttle valve control system according to claim 1, including an automatic choke system for automatically controlling the degree of opening of the choke valve in response to a change in temperature of the engine, wherein the choke lever is positioned to oppose the automatic choke system thereby making the throttle valve closure restricting means inoperative.

4. The carburetor throttle valve control system according to claim 2, including an automatic choke system for automatically controlling the degree of opening of the choke valve in response to a change in temperature of the engine, wherein the choke lever is positioned to oppose the automatic choke system thereby making the throttle valve closure restricting means inoperative.

* * * * *